US005330328A

United States Patent [19]

Cooper

[11] Patent Number: 5,330,328

[45] Date of Patent: Jul. 19, 1994

[54] SUBMERSIBLE MOLTEN METAL PUMP

[76] Inventor: Paul V. Cooper, 8389 Sherman Rd., Chesterland, Ohio 44026

[21] Appl. No.: 13,097

[22] Filed: Feb. 3, 1993

Related U.S. Application Data

[62] Division of Ser. No. 748,145, Aug. 21, 1991, Pat. No. 5,203,681.

[51] Int. Cl.[5] ..... F04B 17/00

[52] U.S. Cl. ..... 417/424.1; 285/419; 285/412; 464/182

[58] Field of Search ..... 417/424.1; 285/419, 285/373, 368, 412; 464/182, 185, 901

[56] References Cited

U.S. PATENT DOCUMENTS

| | | | |
|---|---|---|---|
| 2,787,873 | 4/1957 | Hadley | 464/182 |
| 2,978,885 | 4/1961 | Davison | 464/182 |
| 3,048,384 | 8/1962 | Sweeney et al. . | |
| 3,070,393 | 12/1962 | Silverberg et al. | 464/182 |
| 3,092,030 | 6/1963 | Wunder . | |
| 3,255,702 | 6/1966 | Gehrm . | |
| 3,759,635 | 9/1973 | Carter et al. . | |
| 3,836,280 | 9/1974 | Koch . | |
| 3,984,234 | 10/1976 | Claxton et al. . | |
| 4,052,199 | 10/1977 | Mangalick . | |
| 4,169,584 | 10/1978 | Magnalick . | |
| 4,351,514 | 9/1982 | Koch . | |
| 4,410,299 | 10/1983 | Shimoyama . | |
| 4,786,230 | 11/1988 | Thut . | |
| 4,842,227 | 6/1989 | Harrington et al. . | |
| 4,898,367 | 2/1990 | Cooper . | |
| 5,098,134 | 3/1992 | Monckton | 285/419 |
| 5,131,632 | 7/1992 | Olson | 285/419 |

FOREIGN PATENT DOCUMENTS

| | | | |
|---|---|---|---|
| 2542807 | 3/1977 | Denmark | 285/419 |
| 0002019 | of 1902 | United Kingdom | 285/419 |

OTHER PUBLICATIONS

H.T.S. Pump Equation for the Eighties, High Temperature Systems, Inc., 16755 Park Circle Drive, Chagrin Falls, Ohio 44022.

METAULLICS ®, Transfer Pump Systems for Molten Metals, Installation, Operation and Maintenance Instructions, A. Sohio Company, ®Copyright 1984, Metaullics Systems 31935 Aurora Road, Solon, Ohio 44139.

METAULLICS ®, De-Gas/De-Mag Systems for Aluminum, Installation, Operation and Maintenance Instructions, The Carborundum Company, Metaullics Systems Aurora Road, Solon, Ohio 44139.

(List continued on next page.)

*Primary Examiner*—Richard A. Bertsch
*Assistant Examiner*—Alfred Basichas
*Attorney, Agent, or Firm*—Nikaido, Marmelstein, Murray & Oram

[57] ABSTRACT

A coupling device vertically couples one shaft which is substantially axially aligned to a second shaft. The device includes a flexible coupling unit attached to an end of one shaft, with a coaxial flange thereupon. The end of the second shaft has a concentric locating bore and a diameter. A split coupling is provided to the second shaft and includes two half flanges. Each half flange has a depending half cylindrical member attached thereto. A bolt extends through a diametrical through bolt hole provided in the end of the second shaft, and through a pair of bolt holes in the depending half cylindrical members, positioned such that the upper faces of the half flanges of the split coupling are substantially aligned with the upper end of the second shaft. Pilot flange is provided between the coaxial flange and the half flanges. The pilot flange has a center cylinder which is sized to match and to be received in the concentric locating bore of the second shaft. The flange portion of the pilot flange has tapped holes therein. Appropriately sized shoulder bolts are engaged in the tapped holes, and join the half flanges of the split coupling and the coaxial flange of the flexible coupling unit to the pilot flange. Pins are fitted into matching bores in the pilot flange.

8 Claims, 9 Drawing Sheets

OTHER PUBLICATIONS

METAULLICS ®, Circulation Systems for Aluminum, Installation, Operation and Maintenance Instructions, Standard Oil Engineered Materials, ®Copyright 31935 Aurora Road, Solon, Ohio 44139.

METAULLICS ®, Transfer Pump for Molten Metal, Installation, Operation and Maintenance Instructions, The Carborundum Company, 31935 Aurora Road Solon, Ohio 44139.

METAULLICS ®, M-Series Pumps, Advanced Equipment for Handling and Processing Molten Metal, A Sohio Company, 31935 Aurora Road, Solon, Ohio 44139 ®Copyright 1984.

Furnace Modifications Improve Melt Rate, Fuel Efficiency, *Die Casting Engineer,* pp. 26–27, Jul.–Aug. 1979.

Mechanized Molten Metal, Circulation, by Mahash C. Mangalick, *Die Casting Engineer,* vol. 17, No. 5, pp. 23–31, Sep.–Oct. 1973.

METAULLICS ®, M-series circulation pump runs up to three times longer than its closest competitor. Metaullics, a Sohio Company.

Tecumseh Metal Products Moves Aluminum From Furnace to Machine in 70 Seconds. Reprinted from *Light Metal Age.*

Molten Metal Pumps Speed Die Casting Production, Reprinted from *Precision Metal,* Mar. 1976, Industrial Publishing Co.

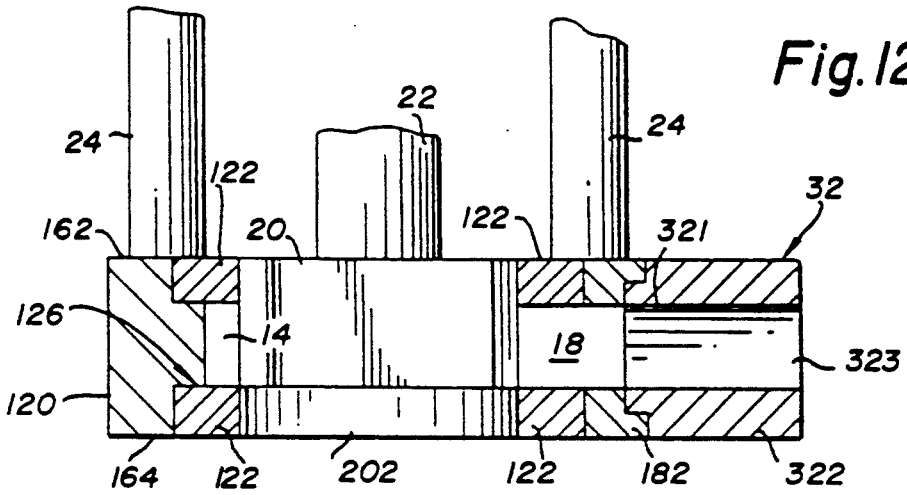
Fig. 12
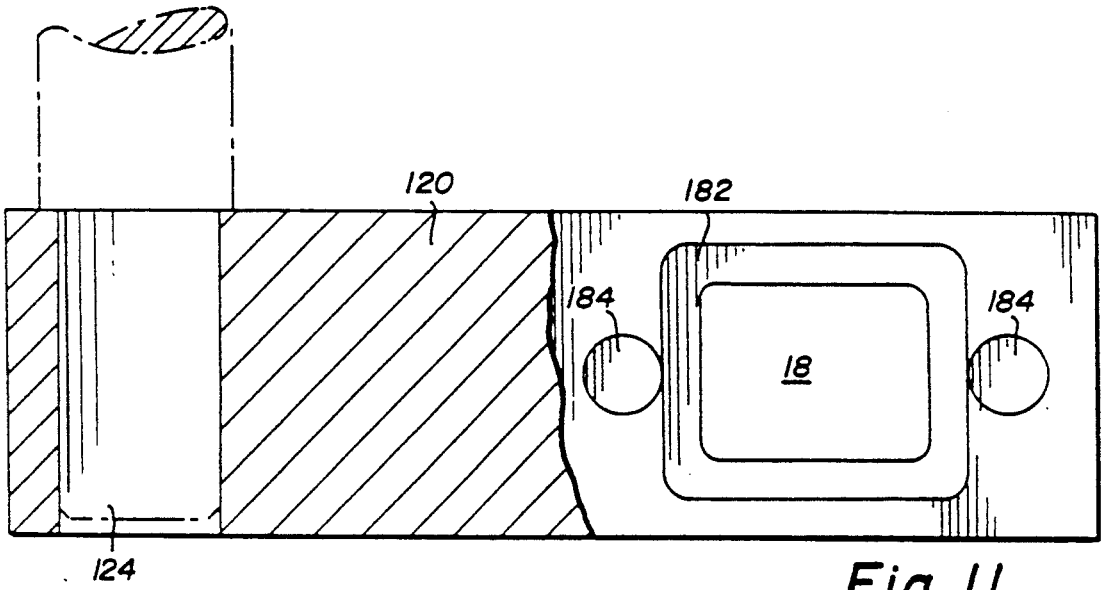
Fig. 11
Fig. 13
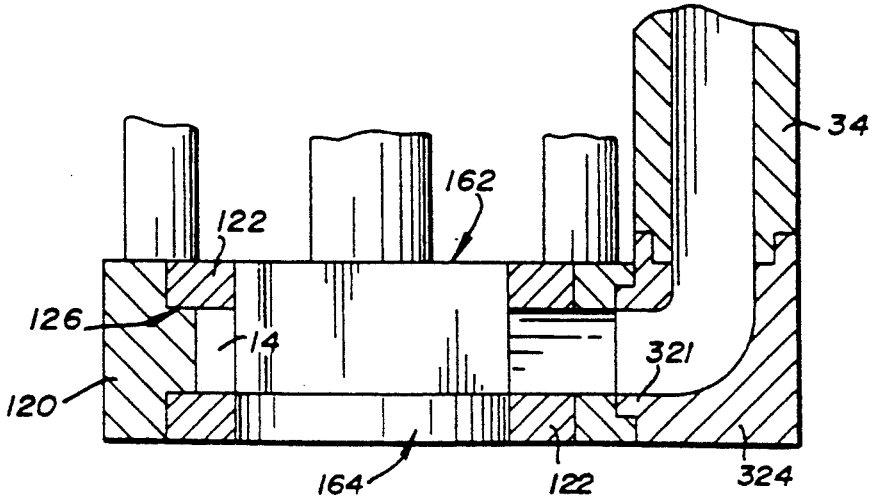

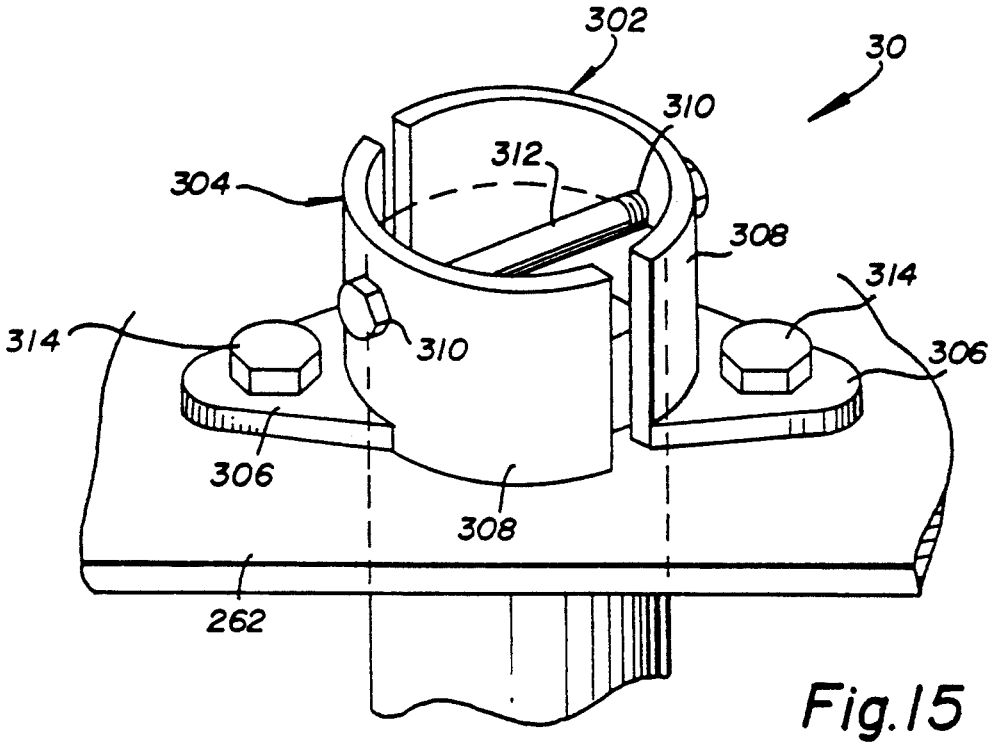
Fig.15
Fig. 14
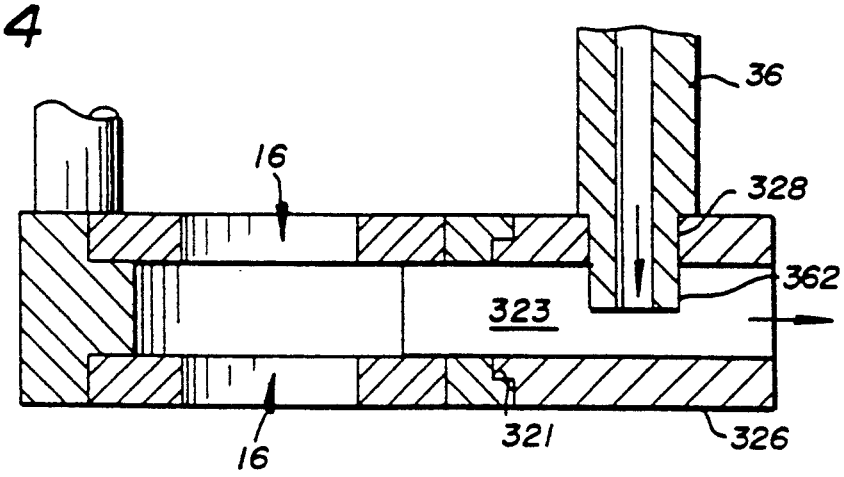

SUBMERSIBLE MOLTEN METAL PUMP

This is a continuation division of application Ser. No. 748,145 filed Aug. 21, 1991 U.S. Pat. No. 5,203,681.

BACKGROUND OF THE INVENTION

The present invention relates to pumps and, in particular, to pumps for pumping molten metal.

A number of submersible molten metal pumps are known in the art, such as that shown in U.S. Pat. No. 2,948,524 to Sweeney et al. Such pumps have been provided for pumping molten metal for various purposes. Great difficulties have been encountered due to the extremely hostile environment of a molten metal bath. The parts exposed to contact with the molten metal must resist this environment. At the metal surface in a molten metal bath of aluminum, for example, the molten metal itself is corrosive, abrasive drosses are present, and the atmosphere immediately above the metal surface is oxidizing. Additionally, splashes and splatters from the bath can cause difficulties and problems on the surfaces of the pump above the molten metal surface. Consequently, materials selection and design are extremely important for a submersible molten metal pump.

In the field of working with molten metals such as aluminum, three basic different types of centrifugal pumps are utilized. First of these is a circulation pump. Circulation pumps are used to equalize temperature and alloy mix throughout a metal bath and circulate a hot metal around the bath. Most often, they are used in conjunction with a reverbatory furnace having an external well. The well is usually an extension of the charging well where scrap metal is charged. A bridgewall is installed to isolate and protect the pump in the external well from damage by direct contact with the charged material. The circulation pump circulates the hot metal around the cold charged scrap dispersing the heat transfer insulating film surrounding the cold scrap thus improving the melt rate of scrap. The circulation also promotes homogeneity in the alloy composition in the bath. With the circulation by such a pump, the surface temperature of the bath is reduced thereby increasing the temperature differential for radiant heat transfer in the furnace thus reducing fuel consumption in the furnace and ultimately increasing production.

A second type of pump is a transfer pump in which the molten metal is taken from the external well of the furnace and transferred to a different location such as a ladle or another furnace.

A third type of molten metal pump is known as a gas-injection pump. Gas-injection pumps circulate the molten metal while adding a gas at the exit of the pump in order to de-mag the molten metal or degas the material. In the purification of molten metals, particularly aluminum, it is frequently desired to remove dissolved gases such as hydrogen, or dissolved metals, such as magnesium. The removing of dissolved gas is known as "degassing" while the removal of magnesium is known as "demagging". Demagging uses chlorine to form magnesium chloride $MgCl_2$. Degassing can use argon (best) or nitrogen (less expensive) to attract the hydrogen in the metal. Both processes require a gas (chlorine, argon, or nitrogen) to be introduced into the molten metal. Generally, the gas is introduced through a gas tube or pipe directly into the base or casing of the pump. If the pump flow rate (metal velocity) is insufficient during demagging, the resultant magnesium chloride is not carried away fast enough and clogs the pump. There can also be a problem if the gas flow rate of chlorine is too high wherein the chlorine will blow a hole through the bottom of the base. In the prior art such as in U.S. Pat. Nos. 4,052,199, 4,169,584, 4,351,514, the gas is introduced into the metal as it is entering or exiting the molten metal pump.

As an example of circulation pumps, reference should be made to U.S. Pat. Nos. 3,984,234, 3,759,635.

As examples of transfer pumps, reference should be made to the above-noted Sweeney et al patent together with U.S. Pat. Nos. 3,048,384 to Sweeney et al, 3,092,030 to Wunder, 3,255,702 to Gehrm, 3,836,280 to Koch, and 4,786,230 to Thut.

In the area of centrifugal pumps, the pump generally includes a casing having a pump chamber and an impeller in the chamber. As is well known in the art, the pump can be designed to be a single suction pump in which case the material to be pumped enters through a single inlet generally in parallel with the pump shaft or can be a double suction pump in which two inlets are provided generally both in line with the pump shaft. The pump chamber in the casing generally defines a volute which is defined for the purpose of this application and as known in the art as a spiral casing for a centrifugal pump with an increasing cross sectional area viewed circumferentially as the outlet of the pump is approached. With the exception of U.S. Pat. No. 3,092,030 to Wunder and U.S. Pat. No. 3,984,234 to Claxon et al, all of these centrifugal pumps noted in the patents above are volute pumps.

In addition to the hostile environment at the interface between the molten metal and atmosphere, even the molten metal bath itself is not homogeneous. That is, certain suspended solids can be present including unmelted chunks of scrap metal, chunks of alloying metals, and contaminants such as refractory brick spalled from the wall of the furnace, chunks of cement, insoluble metal oxide accretions and the like. If such suspended solids of sufficient size enter the inlet of the pump, and are not immediately expelled out of the discharge, they can be caught at the lip of the volute and jam the pump. This leads to breakage of the shaft and/or destruction of the volute. Sometimes the impeller is also destroyed.

In attempts to eliminate or minimize such problems in the past, simple strainers and filters have been applied to the inlet of the pump. Recently, filters have been cemented to the bottom of the base of bottom-feed pumps. It is readily apparent that the same are unsuitable since they rapidly can clog thereby requiring cleaning. A so called "deflector disk" has been mounted for rotation such that its periphery cooperates with the inlet opening of the pump body to define an entrance passageway of suitable dimensions for restriction of admission of solid or semi-solid materials. Such construction adds one more piece to the assembly of the pump.

Additionally, it should be noted that all of the immersed impellers of the pumps of the above-noted patents are either a cup shaped centrifugal impeller having plural radial or angularly directed radial passages with a hollow center portion receiving the molten metal from the inlet and, by centrifugal action, directing the molten metal out the angular radial passages or a vaned impeller having a generally disk shaped web with flat surfaced or curved outwardly radially extending vanes.

Generally, for molten aluminum pumps,.the pump casing and the impeller are made of graphite. Metal pump parts are unsatisfactory since relatively high temperature melting metal, such as iron are dissolved when in contact with molten aluminum, in spite of the fact that molten aluminum may be at a temperature of approximately one-half of that at which iron melts. In such a situation, iron is introduced into the molten aluminum and is considered to be a contaminant.

Generally, in the prior art, the pump casing is connected to a superstructure which is positioned above the interface between the molten metal and atmosphere. Generally, one or more support posts are attached to the casing and extend upwardly therefrom and are connected to the superstructure. Generally, the support posts are slip fitted into blind bores into the pump casing and are secured there by a coating of a refractory cement or adhesive. The support post may be threadingly engaged with the casing with the addition of the cement. During the initial assembly and subsequent rebuilds, the pump must be built on a close tolerance steel alignment fixture. Cement must be manually applied (usually actually using fingers) and is often in uneven amounts under the posts creating different post heights.

At the upper ends, the support posts are generally provided with a coaxial threaded bore. The support post is slipped into a support post sleeve extending downwardly from the superstructure which is packed with a suitable ceramic cement or furnace cement and a bolt is threaded downwardly through the superstructure into the threaded bore at the top of the support post. Problems are encountered due to such structures when it is desired to replace these support post. If the interconnection between the support post and the pump casing is by threading or by conventional blind hole (typically not threaded), the post has to be cut off at the top of the casing and very careful, difficult, labor-intensive manual hammer and chisel work is required to remove the parts of the old post. At the upper end of the post and superstructure connection, the post has to be cut off just below the sleeve and careful, labor-intensive manual hammer and chisel work is required to remove all of the old post from the sleeve. Because the sleeve depends downwardly from the superstructure cutting off the connection of the support post with the sleeve is subject to any splashing of the molten metal which further complicates the replacement of the support post.

A motor is mounted on top of the superstructure and generally is an air driven pneumatic motor requiring a specific air line and air control valve. In the past, an air motor is preferable because of the extremely harsh environment. Air motors are known to be inefficient and expensive. Additionally, the use of an air motor necessarily requires an air compressor which further adds to maintenance costs and requirements. While the use of a hydraulic motor is certainly possible, considerable danger is present due to the inflammability of hydraulic fluids if there should be a leak. Hydraulic motors are also inherent inefficient and they require a separate hydraulic pump to supply the energy to run them. Further, connection and disconnection of the motor (required when mounting and demounting the pump) would inevitably result in some spillage of hydraulic fluid. It has been thought that conventional electric motors are unsuitable for the environment due to the metal dust, oxidizing atmosphere, extreme heat, and other hostile factors. Specially built electric motors have been used successfully but greatly increase the expense and cost of the pump.

Various possible mechanisms have been provided in the prior art for coupling the shaft of the motor to the shaft of the pump. These include a bayonet connection fixed to a universal joint, a straight pair of coaxial threaded joints with a universal joint therebetween, and the like. At the opposite end of the pump shaft, generally the connection between pump shaft and impeller has been by male threading on the shaft engaging female threading in the impeller with a distinct shoulder at the junction. Potential problems upon attempted replacement of the shaft or the impeller are encountered similar to the replacement problems with respect to the support post. That is, careful, difficult, labor-intensive manual hammer and chisel work is required to remove all of the old pieces.

OBJECTS AND SUMMARY OF THE INVENTION

It is an object of the present invention to provide a submersible molten metal pump which allows for ingestion of a solid piece or semi-solid piece and expelling of the same from the pump without breakage of any of the pump parts.

It is a further object of the present invention to eliminate the need for a baffle plate or "deflector disk" cooperating with the inlet opening of the pump body to define only a limited opening thereinto while requiring continuous maintenance.

It is another object of the present invention to provide a pump having a stock pump casing suitable for use as a circulation pump, as a transfer pump, or as a gas-injection pump.

It is another object of the present invention to provide a support post for a submersible molten metal pump which while being simple to install is also relatively simple to replace not requiring extensive manual hammer and chisel removal operations from the pump casing or from any superstructure.

It is still a further object of the present invention to provide a support post and pump casing connection that is self perpendicularly aligning, thus not requiring a special jig or fixture for assembly.

It is still a further object of the present invention to eliminate the need for a second set of bearings located on the pump shaft, thus eliminating shaft bearing mounting problems including alleviating potential alignment problems inherent in having two sets of "concentric" bearings only six inches apart.

It is still a further object of the present invention to provide a means for engaging an upper end of the support post at the superstructure which is simple and inexpensive to construct, permits easy replacement of the support post, and is not subject to extensive splashing and coating by materials flying above the molten metal bath. In addition, it is an object to provide such a means for engaging an upper end of the support post at the superstructure which does not require the use of cement or adhesive and which does not require threading.

It is still yet a further object of the present invention to provide a simply constructed mechanism for coupling a motor to the pump shaft via a threadless connection. In this regard it is a further object to provide a graphite to graphite shaft to rotor connection which is self-centering and takes part of the stress off of any threading.

It is still yet a further object of the present invention to provide construction in which a conventional electric motor can be safely and economically utilized for a submersible metal pump in the hostile environment over a molten metal bath. In this connection, it is a further object to provide a method of mounting such a motor to enable simple and easy replacement of the same. If desired, the motor mount should be useable by a variety of types of pumps, such as hydraulic, pneumatic or electric. It is still a further object in this regard to provide for simple cooling of the couplings and connections by shrouding the area adjacent the motor and flowing unfiltered cooling air therethrough.

It is still a further object of the present invention to provide alternative exit adaptors mountable on the stock pump casing in a simple secure manner to enable the stock pump casing to be utilized for a circulation pump, for a transfer pump, or for a gas-injection pump. Additionally, it is an object to provide an exit adaptor for a gas-injection pump that enables more efficient degassing/demagging by having the end of the injection tube nozzle perpendicular to the flow of molten metal to shear off smaller bubbles rather than at an acute or obtuse angle to the molten metal flow. A still further object is to provide the gas-injection pipe in the exit adaptor for the gas-injection pump instead of in the pump casing so that the adaptor itself can be cleaned or replaced without having to clean or replace the entire casing.

These and other objects are obtained in a submersible molten metal pump which comprises the following structure. A pump casing is provided having a cylindrical non-volute pump chamber defined therein, at least one inlet opening, and a tangential discharge opening. An imperforate polygonal rotor is mounted in the chamber and is sized to fit through the at least one inlet opening. An rotor shaft is attached to the rotor and extends upwardly therefrom. At least one support post is attached to the casing and extends upwardly therefrom in parallel with the rotor shaft. A superstructure is positioned above the casing and includes a mounting plate, means on the mounting plate engaging the at least one support post, a motor mount attached to the plate, a motor on the motor mount, and coupling means for operatively connecting the motor to the rotor shaft. The rotor is preferably triangular. A flow-blocking and bearing plate is mounted on one face of the rotor and is sized to rotatably fit and be guided by a bearing ring which is annularly mounted and which defines one of the inlet openings.

The means on the mounting plate engaging the at least one support post can comprise a support post clamp having opposite symmetrical halves. Each half includes a flange portion mountable to the plate and an upstanding half cylindrical portion having an effective inner diameter slightly larger than a diameter of the at least one support post. A through bolt hole is provided in the upstanding half cylindrical portion.

The motor mount includes a horizontal plate having bolt holes matching to the motor mounting bolt holes on the motor with spacers downwardly and radially extending from the motor mounting plate radially outward of the motor mounting bolt circle. This enables air flow adjacent or circumferentially of the spacers. The spacers are then secured to the pump superstructure.

The pump casing can comprise a monoblock of a heat-resistant material. A cylindrical, non-volute chamber is provided in the block. In the smaller sizes of pump, the chamber can be off-center while in the larger sizes, it is centered. At least one circular inlet opening is defined co-axially with the chamber. Preferably, two inlet openings, one on the top and one on the bottom are provided (with one of the two being blocked by a flow-blocking plate mounted on the rotor). A discharge opening having an axis tangential to the chamber is provided in a side wall of the monoblock. At least one cylindrical support post hole extends through the entire monoblock and has an axis in parallel with the axis of the chamber. The monoblock can have a stepped surface defined at the periphery of the chamber on each side of the monoblock. The casing can further comprise-base bearing ring members mating with the stepped surfaces. This defines the chamber and provides the circular inlet opening. Preferably, the bearing ring members are provided at both sides of the casing and guide the flow-blocking and bearing plate and rotor as described below. This construction allows easy manufacture of the pump since it is a simple machining operation to shape the pump chamber in the monoblock. Further, the pump is relatively easy to clean out by breaking out the bearing ring members.

In another aspect of the invention, the invention can comprise a pump assembly for a submersible molten metal pump comprising a casing having defined therein a pump chamber for housing a rotor, at least one inlet opening into the chamber and discharge opening having an axis aligned tangentially to the chamber, an exit adaptor, and means for mounting the exit adaptor at the discharge opening. The exit adaptor can comprise a straight, preferably rectangular cross-sectioned piece having a central bore equal in diameter to the discharge opening whereby the pump assembly can be used for a circulation pump. Alternatively, the exit adaptor can be an elbow fitting engageable by a discharge pipe whereby the pump assembly can be used for a transfer pump. Further, the exit adaptor can comprise a member having a main bore equal in diameter to the discharge opening and a vertical bore extending from a top surface thereof perpendicular to the main bore. A gas pipe can be fitted into the vertical bore and extend into the main bore whereby the pump assembly can be used for a gas-injection pump in connection with a means for supply of the particular gas for demagging or degassing.

One means for mounting the exit adaptor at the discharge opening can include a concentric annular step at the discharge opening. A matching annular projection can be provided on the exit adaptor. The exit adaptor and the casing are provided with a pair of cylindrical bores flanking the discharge opening. Pins are provided in the bores with each pin having an axis parallel to the axis of the discharge opening and engaging with the casing and with the exit adaptor. The pins take the majority of the vertical forces that may be exerted on the exit adaptor. These elements are secured together by a suitable cement.

A second means for mounting the exit adaptor at the discharge opening includes a larger cutout in the casing with the concentric annular step at the discharge opening formed in the bottom of the cutout. The matching annular projection is provided on the exit adaptor with the exit adaptor fitting substantially into the cutout. The exit adaptor and the casing are provided with a pair of cylindrical bores flanking the discharge opening with the bores being equally cut into the adaptor and the casing. The pins take the majority of the vertical forces that may be exerted on the exit adaptor. These elements are secured together by a suitable cement.

Another aspect of the invention resides in the support post for the pump for suspending a casing having a vertical bore therethrough from a mounting plate having an opening therein with a post socket clamp mounted in line with the opening of the mounting plate and extending upwardly therefrom. The post can comprise a cylindrical body of a refractory material or graphite. One end of the post has a stepped portion fitable through the opening of the mounting plate and in the post socket. The stepped portion has a diametrical bore for receiving a bolt which extends through a pair of holes in the post clamp perpendicular to the axis of the support post. The lower end of the post has a stepped portion defined by upper and lower locating shoulders which define an axially extending circumferential adhesives groove and which center the post in the support post hole. This stepped portion is sized to fit in the vertical bore in the casing and extends substantially completely therethrough. The post has a further squared upper shoulder being positioned such that the flat end of the support post is approximately flush with the bottom of the casing when the post is inserted in the vertical bore. The lower end of the post further includes an adhesives passageway diagonally extending from the outer surface of the post at a position above the squared upper locating shoulder and opening into the circumferential adhesives groove. With the post dry fitted into the vertical bore of the pump casing, using a cement-filled caulking gun, adhesives can simply be squirted through the adhesives passageway to fill the circumferential adhesives groove. This enables simple and easy assembly of the support post to the pump casing.

A still further aspect of the present invention resides in the coupling between the motor and the pump-shaft. It includes a coupling device for vertically coupling one shaft substantially axially aligned to a second shaft. A flexible coupling unit such as an Oldham coupling, a double engagement coupling, or a "Fast's" steel coupling is attached to one end of one shaft and has a co-axial flange. The other shaft has a concentric locating bore and a diameter. A split coupling is provided to the second shaft being made up of two half flanges each having a depending half cylindrical member attached thereto. Through bolt holes are provided in the depending half cylindrical members and a bolt extends through the through bolt holes and a diametrical bore in the end of the second shaft. This diametrical bore is positioned such that the upper face of the flange of the split coupling is substantially aligned with the upper end of the second shaft. On the outside of one of the depending half cylindrical members is a clip-type nut holder. A pilot flange is provided between the co-axial flange of the flexible coupling unit and the flange of the split coupling. The pilot flange has a center cylinder extending co-axially from it sized to match and be received in the concentric locating bore of the second shaft. Tapped holes are provided in the flange portion of the pilot flange for each half of the split coupling to be mounted to the pilot flange and for the co-axial flange of the flexible coupling unit to be matched from the other side to the pilot flange. The use of tapped holes in the pilot flange enables the use of appropriately sized shoulder bolts making a very compact and rigid connection which is yet simple to manufacture and simple to take apart and put together. In order to complement the shear strength of the bolts, pins are also provided which are fitted into matching bores in the pilot flange.

In conjunction with the above described motor mount plate, another aspect of the invention resides in providing on the superstructure a steel cylindrical pipe surrounding the coupling between the motor shaft and the pump shaft and extending upwardly to the motor flange mounting plate. A further cylinder extends upwardly from the motor flange mounting plate and at least partially surrounds the motor mounted thereon. A cooling air pipe is provided laterally of the steel cylindrical pipe to enable cooling air to be provided via a small low pressure volume blower which uses unfiltered (remote) plant air. Windows are cut in the sides of the steel cylindrical pipe. Cover members close the windows. The windows are provided to enable access to the coupling unit.

BRIEF DESCRIPTION OF THE DRAWINGS

The above and other objects and the attendant advantages of the present invention will become readily apparent by reference to the following detailed description when considered in conjunction with the accompanying drawings wherein:

FIG. 11 is a cross-sectional view taken along line 11— 11 of FIG. 3;

FIG. 12 is a partial view of the present invention embodied as a circulation pump;

FIG. 13 is a partial view of the present invention embodied as a transfer pump;

FIG. 14 is a partial view of the present invention embodied as a degassing (gas transfer) pump;

FIG. 15 is a partial perspective view of a support post clamp in accordance with the present invention;

DETAILED DESCRIPTION OF PREFERRED EMBODIMENTS

In the present invention, the materials that are in contact with the molten metal in the bath are fabricated from a structural refractory material. That is, they are fabricated from a material subject to structural fabrication and having high resistance to disintegration by either corrosive or erosive attack from a bath of the molten metal. The material has to have capacity to remain relatively stable and to not introduce contaminants into the molten metal. Structural carbonaceous refractory materials, such as carbon of a dense or structural type, graphite, graphitized carbon, clay-bonded graphite, carbon-bonded graphite, silicon carbide, or the like have all been found to be highly resistant to attack by molten metal, such as aluminum. Such material may be coated or uncoated and glazed or unglazed. Pump parts composed of suitable materials may be made by mixing ground graphite or silicon carbide with a fine clay binder, forming the part and baking. The parts may be subjected to simple machining operations for the silicon carbide or "hard" ceramics or complex machining operations for graphite or "soft" ceramics. Alternatively, some parts such as the support posts, can be made from a metal having a suitable structural refractory material extensive coating.

The provision of both inlet openings can enable double suction for the rotor. Any ingested solid or semi-solid objects are ejected out of the discharge opening. If the pump is being used as a transfer pump, such solid inclusions transferred to the ladle can simply and easily be removed from the molten metal being transferred by an appropriate treatment in the ladle such as described in U.S. Pat. No. 4,898,367 to Cooper.

The interior cross section of the pump chamber can be semi-circular, rectangular, or rectangular with squared and rounded inner radius corners. For ease of construction, the cross-section is preferred to be rectangular. This enables a single simple bore to be utilized in the monoblock casing with a single step seat on each side of the bore for the bearing ring members. Because of the inventive rotor and casing structure, no rotary deflection disk positioned above or below the inlet opening, no stationary deflector disk, no screening or sieves are at all necessary or even desirable. Because of the concentric design of the pump chamber and the solid imperforate rotor, jamming of the pump is not possible by any ingested solid materials. This eliminates, among any things, shaft breakage problems. The provision of a standard single pump casing with differing exit adaptors avoids costly machining and specialty expensive inventories for differing pump designs and enables simple assembly. The provision of the bearing ring member in a step surface portion defining the chamber and the periphery of the inlet opening or openings of the pump enables a simple bearing design with easy alignment of the bearing with respect to the axis of the pump chamber and the axis of the pump shaft and rotor.

Figure 1:
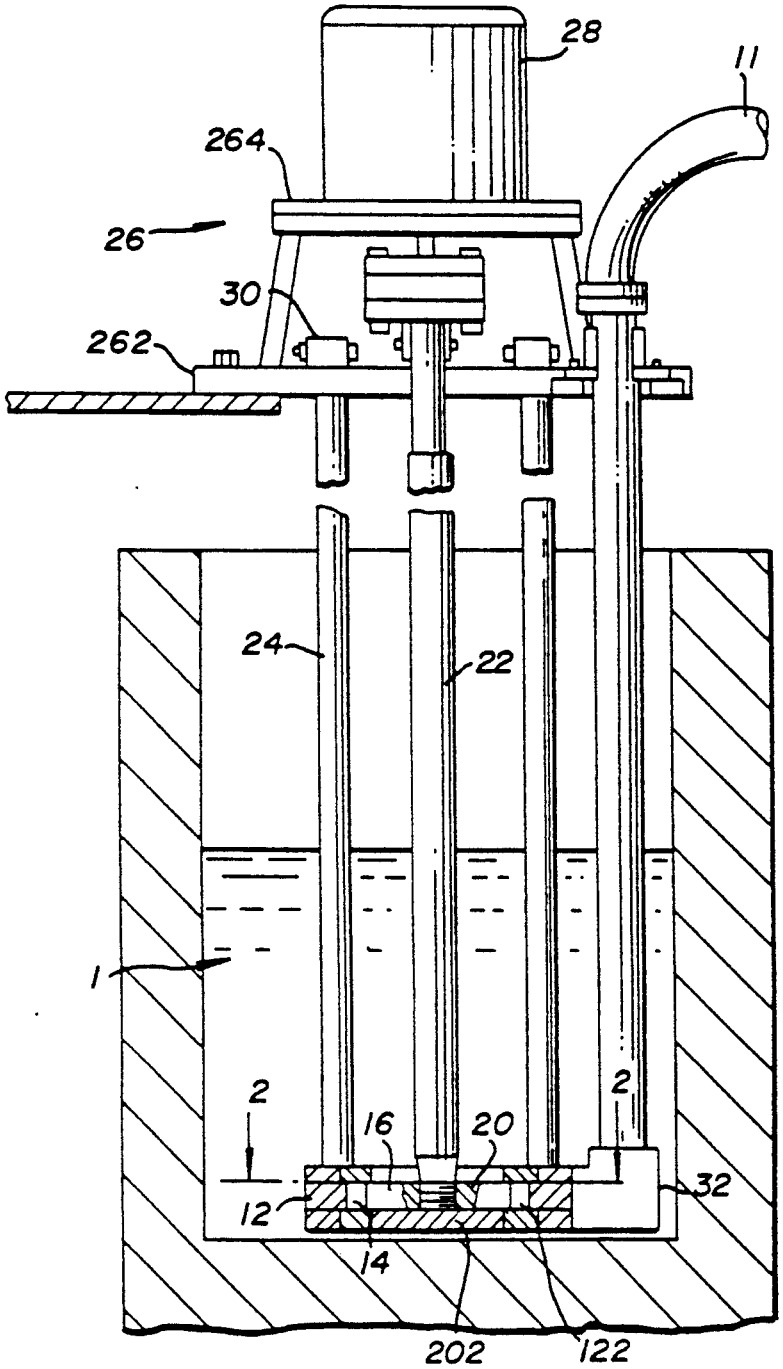
FIG. 1 is an elevational view, with parts broken away, of an embodiment of the present invention in operative association with a molten metal bath.
Figure 2:
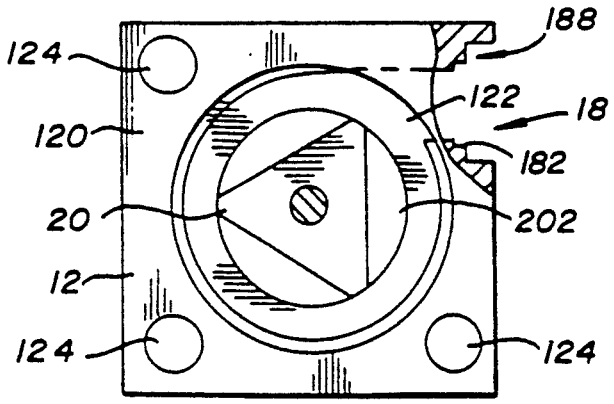
FIG. 2 is an enlarged, cross sectional view taken along line 2 of FIG. 1.
Figure 3:
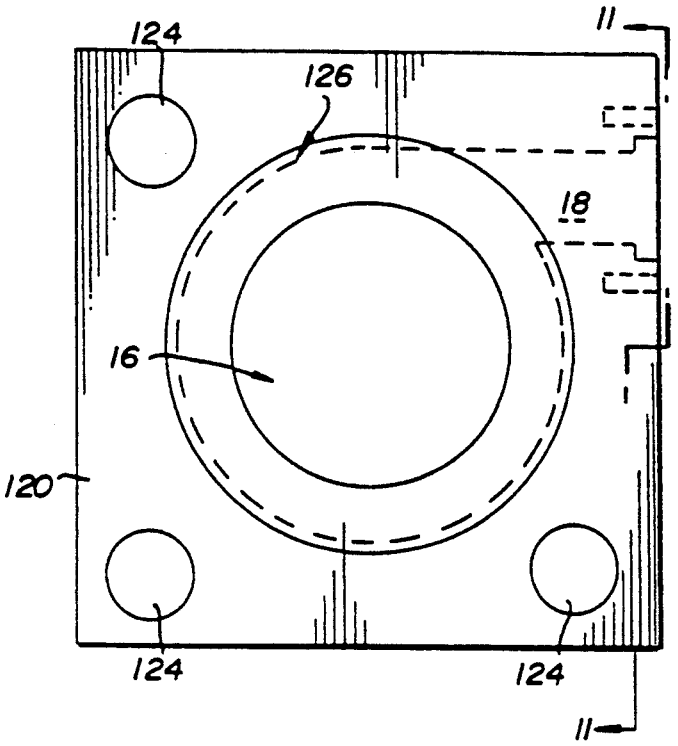
FIG. 3 is a top plan view of the pump casing aspect of the present invention.

As can be seen in FIGS. 1 and 2, the molten metal pump 10 is mounted in a molten metal bath 1. The pump 10 includes a pump casing 12 having a cylindrical non-volute pump chamber 14 defined therein, at least one inlet opening 16, and a tangential discharge opening 18. An imperforate polygonal rotor 20 is mounted in the chamber 14 and is sized to fit through the at least one inlet opening 16. A rotor shaft 22 is attached to the rotor 20 and extends upwardly therefrom. At least one support post 24 is attached to the casing 12 and extends upwardly therefrom in parallel with the rotor shaft 22. A superstructure 26 is positioned above the casing 12 and includes a mounting plate 262, means on the mounting plate 262 engaging the at least one support post 24, a motor mount 264 attached to the plate 262, a motor 28 on the motor mount 264, and coupling means for operatively connecting the motor 28 to the rotor shaft 22. The rotor 20 is preferably triangular. A flow-blocking and bearing plate 202 is mounted on one face 204 or 205 of the rotor (see FIG. 10) and is sized to rotatably fit and be guided by the appropriate one of the bearing rings 122 annularly mounted in the casing and defining the inlet openings 16.

The means on the mounting plate 262 engaging the at least one support post 24 can comprise a support post clamp 30 having opposite symmetrical halves 302, 304 as shown in FIG. 15. Each half includes a flange portion 306 mountable to the plate and an upstanding half cylindrical portion 308 having an effective inner diameter slightly larger than a diameter of the at least one support post 24. A through bolt hole 310 is provided in each upstanding half cylindrical portion 308 and in the upper end of the support post 24. A through bolt 312 is passed through the holes and tightened to clamp the top end of the support post 24 solidly while also preventing any rotation. This connection enables tight gripping of the post without the necessity of cement and by its design, ensures close to absolute perpendicularity of the post 24 relative to the plate 262. Further, it enables the post 24 to be replaced with a minimum of manual labor removing the post and positioning and attaching the replacement. Simple bolt holes can be provided for the bolts 314 used for the connection of flange portions 306 to the mounting plate 262.

This structure for the support post clamp 30 eliminates the use or need for the support posts being generally provided at the upper ends with a coaxial threaded bore and the need for a suitable ceramic cement or furnace cement packed into a downwardly facing sleeve and the bolt threaded downwardly through the superstructure into the threaded bore at the top of the support post. Because the clamp 30 does not depend downwardly from the superstructure, the clamp is not subject to any direct intense heat or splashing of the molten metal which further simplifies the replacement of the support post.

Thus, the further object of the present invention to provide a means for engaging an upper end of the support post at the superstructure which is simple and inexpensive to construct, permits easy replacement of the support post, is not subject to extensive splashing and coating by materials flying above the molten metal bath, and is perpendicular is enabled. In addition, the object to provide such a means for engaging an upper end of the support post at the superstructure which does not require the use of cement or adhesive and which does not require threading is also enabled.

The pump casing 12 can comprise a monoblock 120 of a heat-resistant material as shown in FIGS. 2, 3, 11, 12, and 13. A cylindrical, non-volute chamber 14 is provided in the block 120. In the smaller sizes of pump, the chamber 14 can be off-center while in the larger sizes, it is centered. At least one circular inlet opening 16 is provided co-axially with the chamber 14. Preferably, two inlet openings 16, one on the top 162 and one on the bottom 164 are provided (with one of the two being blocked by a flow-blocking plate 202 mounted on the rotor 20). A discharge opening 18 having an axis tangential to the chamber is provided in a side wall of the monoblock 120. At least one cylindrical support post hole 124 extends through the entire monoblock 120 and has an axis in parallel with the axis of the chamber 14. The monoblock 120 has a stepped surface 126 defined at the periphery of the chamber 14.

The casing 12 further comprises bearing ring members 122 as most clearly shown in FIG. 12, each having an outer periphery corresponding and mating with the stepped surface 126 in the monoblock and an inner periphery defining the circular inlet opening 16. This enables simple and easy cementing of the bearing members 122 into the monoblock 120. The two bearing ring members together with a straight cylindrical bore in the monoblock define the non-volute chamber.

Figure 5:
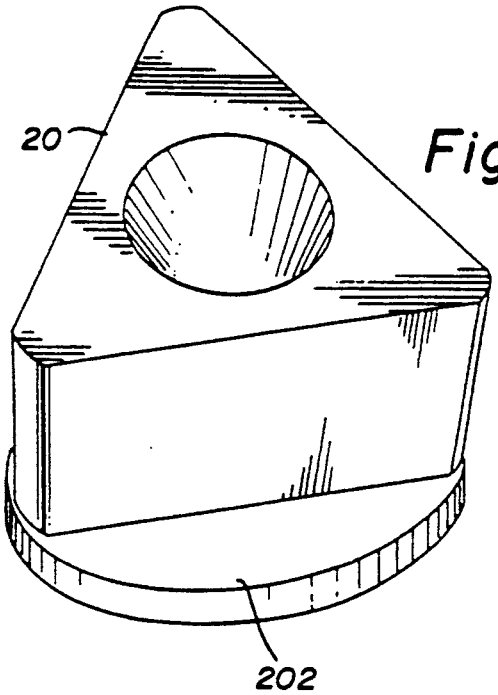
FIG. 5 is a perspective view of one embodiment of the rotor aspect of the present invention.
Figure 6:
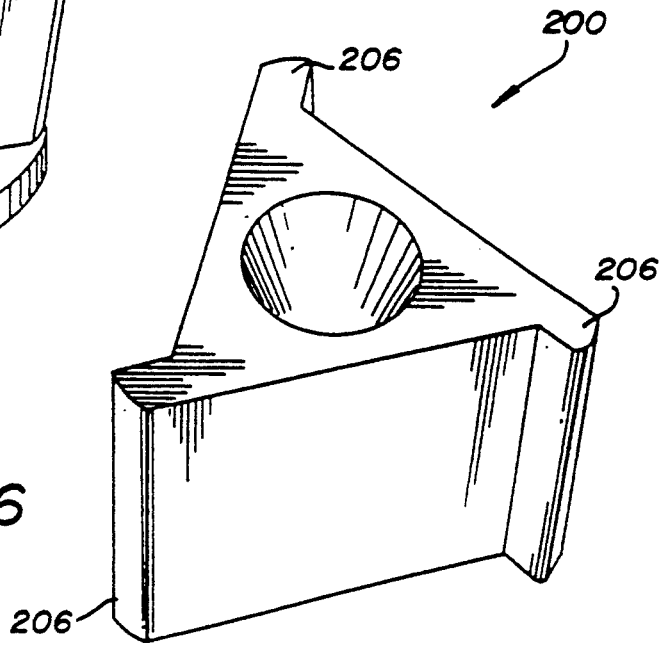
FIG. 6 is a perspective view of a second embodiment of the rotor aspect of the present invention.
Figure 10:
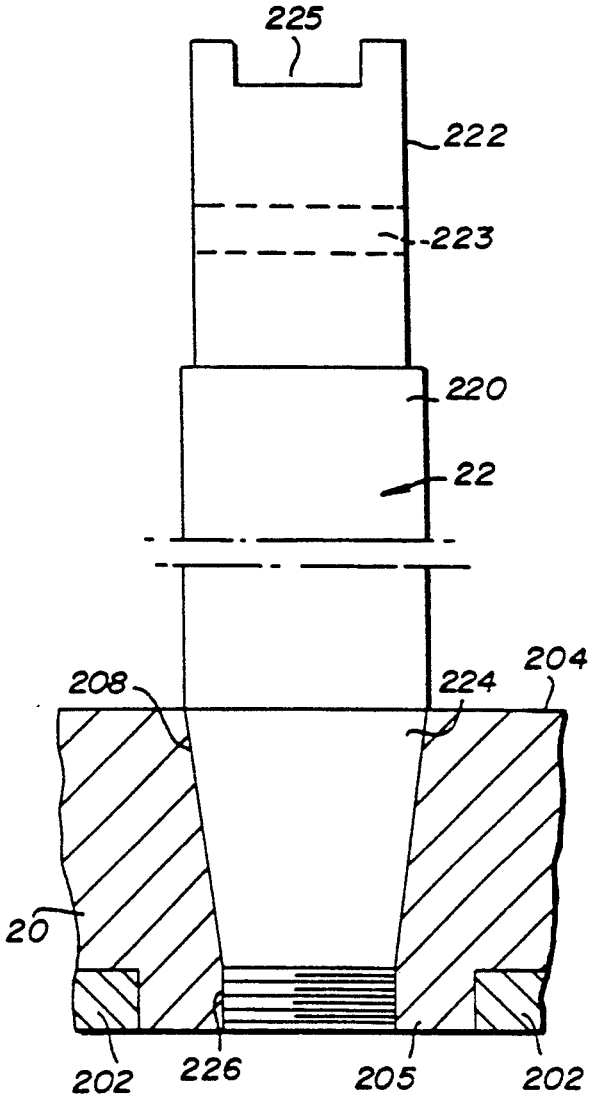
FIG. 10 is view of the pump drive shaft in accordance with the present invention.

As shown in FIG. 5, the preferred rotor 20 has a triangular cross-section in plan and a rectangular shape in elevation. An alternative variation is shown in FIG. 6 having winglets 206 at the tips of the triangle. This provides the benefit of increased head pressures being generated with possible minimal increase danger of objects being wedged. If the pump is being operated with one inlet opening, the flow-blocking and bearing plate 202 is mounted on the other surface of the rotor 20. This is accomplished by the machining of the rotor to leave a coaxial projection on the desired face (FIG. 10). The plate 202 is annularly shaped and sized to be cemented to the projection. The connection between the rotor shaft 22 and the rotor 20 is discussed below.

Figure 7:
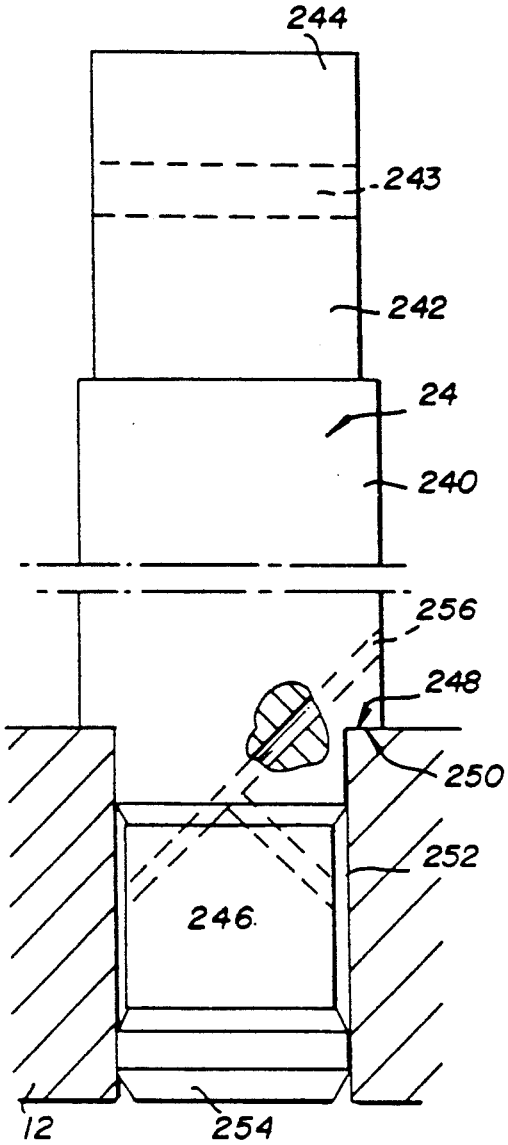
FIG. 7 is a partial view of the support post in accordance with the present invention.
Figure 8:
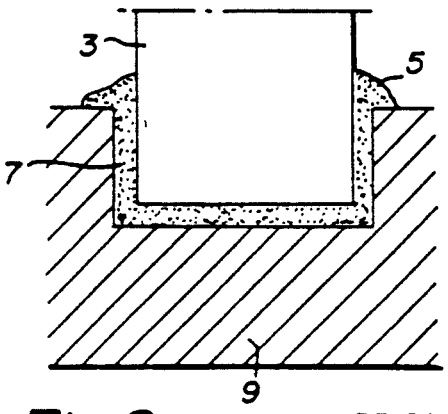
Fig.8 PRIOR ART
FIG. 8 is a view of the lower end of a prior art support post.
Figure 9:
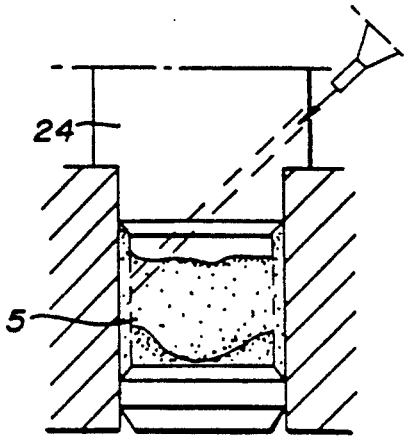
FIG. 9 is a partial view of the support post in accordance with the present invention while cement is being introduced.

FIGS. 7 through 9 show connections between the casing and the support post. In particular, FIG. 8 shows the typical prior art connection where the support posts 3 are slip fitted into blind bores 7 into the pump casing 9 and are secured there by a coating 5 of a refractory cement or adhesive. The support post 3 may be threadingly engaged with the casing 9 with the addition of the cement 5. Cement is manually applied (usually actually using fingers) and is often in uneven amounts under the posts creating different post heights.

The post 24 can comprise a cylindrical body 240 of a refractory material or graphite as shown in FIG. 7. One end 244 of the post 24 has a stepped portion 242 fitable through the opening of the mounting plate 262 and in the post clamp 30. The stepped portion 242 has a diametrical bore 243 for receiving the bolt 312 which extends through the pair of holes 310 in the post clamp 30 perpendicular to the axis of the support post 24. The other end 254 of the post 24 has another stepped portion 248 defined by an upper locating shoulder 250 and includes an axially extending circumferential adhesives groove 252. The another stepped portion 248 is sized to fit in the vertical bore 124 in the casing 12 and extends completely therethrough with the upper shoulder 250 being positioned such that the flat end 254 of the support post 24 is preferably flush with the bottom of the casing when the post 24 is inserted in the vertical bore 124. The other end 254 of the post 24 further includes an adhesives passageway 256 diagonally extending from the outer surface of the post at a position above the locating shoulder 250 and opening at at least one position into the circumferential adhesives groove 252. With the post 24 dry fitted into the vertical bore 124 of the pump casing 12 as shown in FIG. 9, adhesives 5 can simply be squirted through the adhesives passageway 256 using a cement-filled caulking gun to fill the circumferential adhesives groove 252. This enables simple and easy assembly of the support post 24 to the pump casing 12.

In accomplishing one object of the invention, a graphite to graphite shaft to rotor connection which is self-centering and takes part of the stress off of any threading is shown in FIG. 10. The generally graphite pump shaft 22 can comprise a cylindrical main body 220 having at one end 222 structure for coupling with a motor 28 (described below) and at the other end 224 structure for coupling with the rotor 20. In order to couple with the rotor, the lower end 224 of the shaft 22 is tapered at an angle of approximately three degrees with a matching taper being provided in the shaft bore 208. The lowermost one inch of the shaft end 224 is threaded. This enables simple and easy assembly of the shaft 22 to the rotor 20 which is self-centering and takes part of the stress off of the threading.

Figure 4:
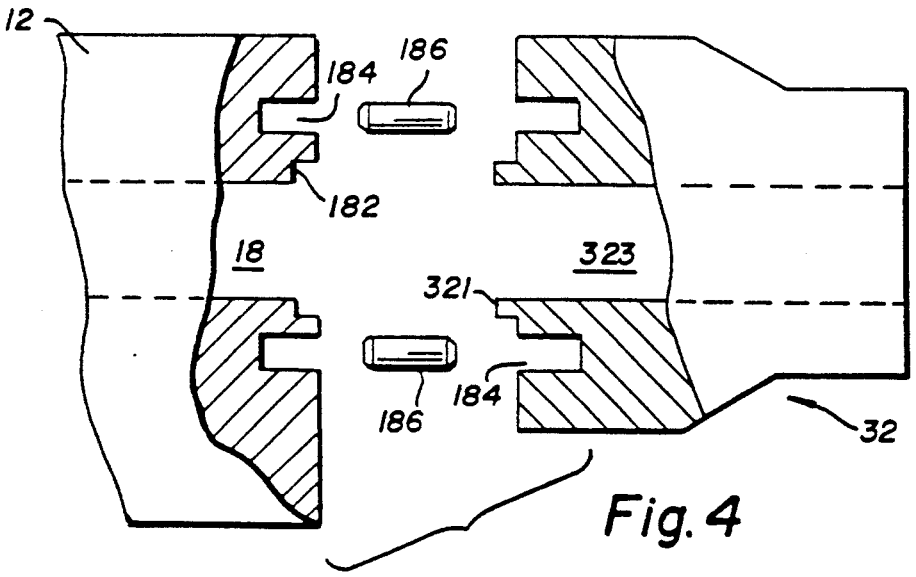
FIG. 4 is a partial fragmentary plan view of the exit adaptor aspect of the present invention.

As previously noted, in the area of molten metal pumps, there are three types of pump, circulation, transfer, and gas injection. The present invention contemplates a pump having a stock pump casing suitable for use as a circulation pump, as a transfer pump, or as a gas-injection pump. This is accomplished by providing alternative exit adaptors mountable on the stock pump casing in a simple secure manner to enable the stock pump casing to be utilized for a circulation pump, for a transfer pump, or for a gas-injection pump. The pump has means for mounting the exit adaptor at the discharge opening 18 of the casing 12 as shown in FIG. 4 which includes a concentric annular step 182 at the discharge opening 18, and a matching annular projection 321 on the exit adaptor 32. The exit adaptor 32 and the casing 12 are provided with a pair of cylindrical bores 184 flanking the discharge opening 18. Pins 186 are cemented in the bores 184 with each pin 186 having an axis parallel to an axis of the discharge opening 18 and engaging with the casing 12 and with the exit adaptor 32.

A second means for mounting an exit adaptor at the discharge opening 18 can include a large cutout 188 in the casing 12 (FIG. 2) with the concentric annular step 182 at the discharge opening 18 formed in the bottom of the cutout 188. The matching annular cylindrical projection would be provided on the exit adaptor with the exit adaptor fitting substantially into the cutout 188. The exit adaptor and the casing would be provided with a pair of cylindrical bores flanking the discharge opening with the bores being equally cut into the adaptor and the casing. Pins inserted in the bores could take the majority of the vertical forces that may be exerted on the exit adaptor. These elements would be secured together by a suitable cement.

For use of the pump as a circulation pump, the exit adaptor 32 comprises a straight piece 322 having a central main bore 323 equal in diameter to the discharge opening 18 as shown in FIG. 12. If required by circumstances, the straight piece 322 can simply be a ring sized to fill the annular step 182, and the bores 184 can be filled with short pins.

Figure 16:
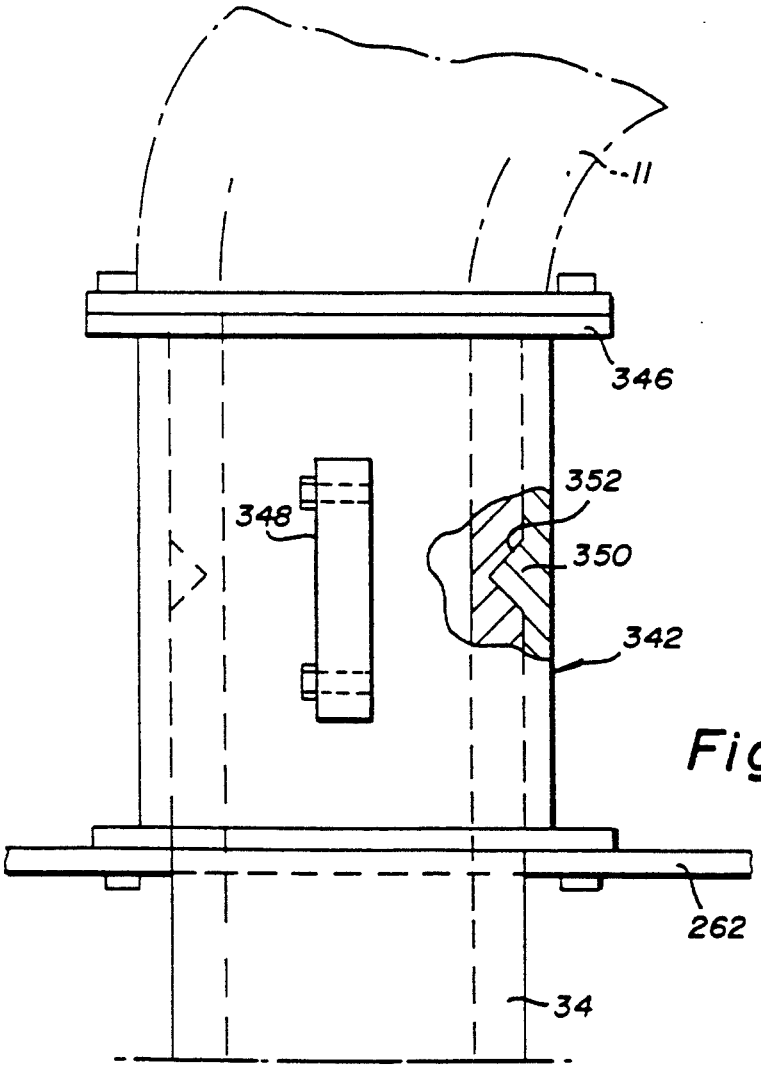
FIG. 16 is a partial sectioned view of the discharge pipe support clamp and adaptor for the present invention embodied as a transfer pump.
Figure 17:
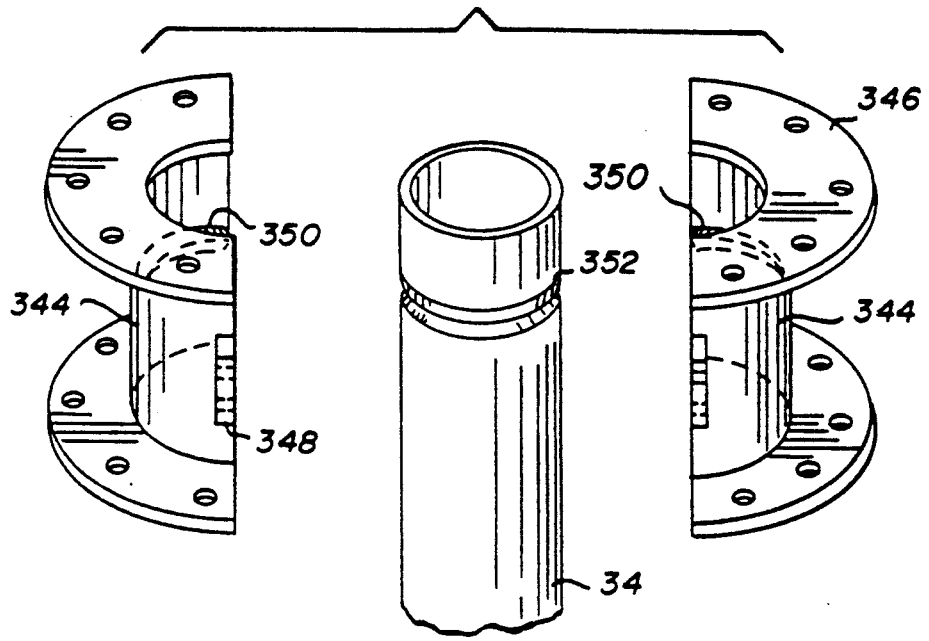
FIG. 17 is an opened perspective view of the clamp of FIG. 17.

For use as a transfer pump, the exit adaptor 32 is an elbow fitting 324 engageable by a discharge pipe 34 as shown in FIGS. 1 and 13. As shown in FIGS. 16 and 17, the discharge pipe 34 in turn is engaged by a pipe coupling adaptor 342 which comprises two symmetrical half units 344 flange-connected to the mounting plate 262 of the superstructure each having one half of a standard pipe flange 346 at its top and a pair of plate flanges 348 along its vertical edges. At the approximate middle of the inner surface of each of the halves can be an inwardly protruding triangular ridge 350 which would engage a corresponding groove 352 in the pipe 34. A standard pipe flange connected to a standard, refractorylined pipe elbow 11 is bolted to the top of the combined pipe flange halves 346. The pipe coupling adaptor not only provides the necessary transition from the graphite discharge pipe necessary in the environment of the metal bath, but also supports the weight of the discharge pipe without needing additional cementing when assembled.

For use as a gas-injection pump, the exit adaptor 32 in a first embodiment is shown in FIG. 14 and comprises a member 326 having a central main bore 323 equal in diameter to the discharge opening 18 and a vertical bore 328 extending from a top surface thereof perpendicular to the main bore 323. A gas pipe 36 is directly fitted to the vertical bore 328 and extends at least into the main bore 323. It is most preferable that the tip 362 of the nozzle of the gas pipe 36 extend into the middle of the main bore 323 to enable more efficient degassing/demagging by having the end of the injection tube nozzle in the center of the flow of molten metal and perpendicular to the flow of molten metal to shear off smaller bubbles rather than at an acute or obtuse angle to the molten metal flow. Having the end of the injection tube flush with the top inner surface of the adaptor would probably result in the bubbles of gas not being contained in the molten metal, but rather, simply rolling along the top inner surface of the exit adaptor and then rising.

Figure 18:
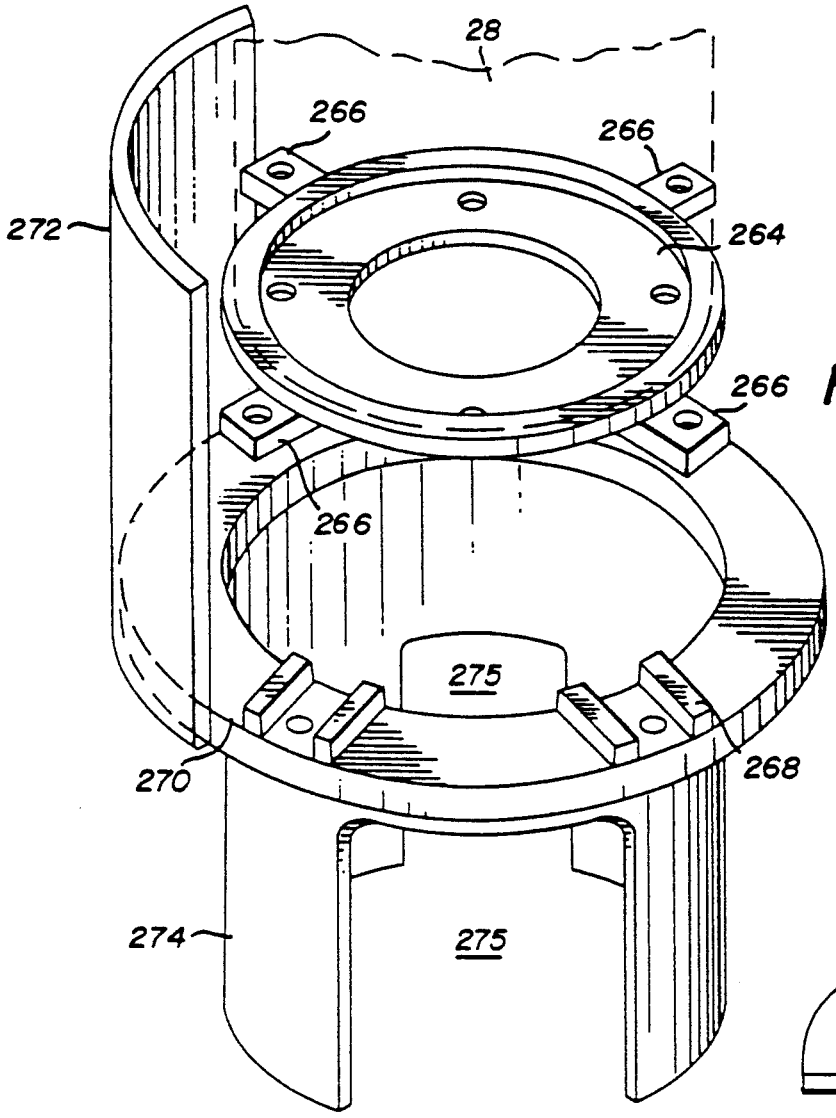
FIG. 18 is an exploded perspective view of a motor mount in accordance with the present invention.
Figure 19:
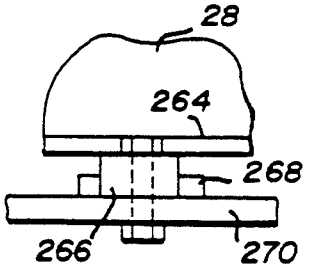
FIG. 19 is a view of a detail seen radially from FIG. 18.
Figure 21:
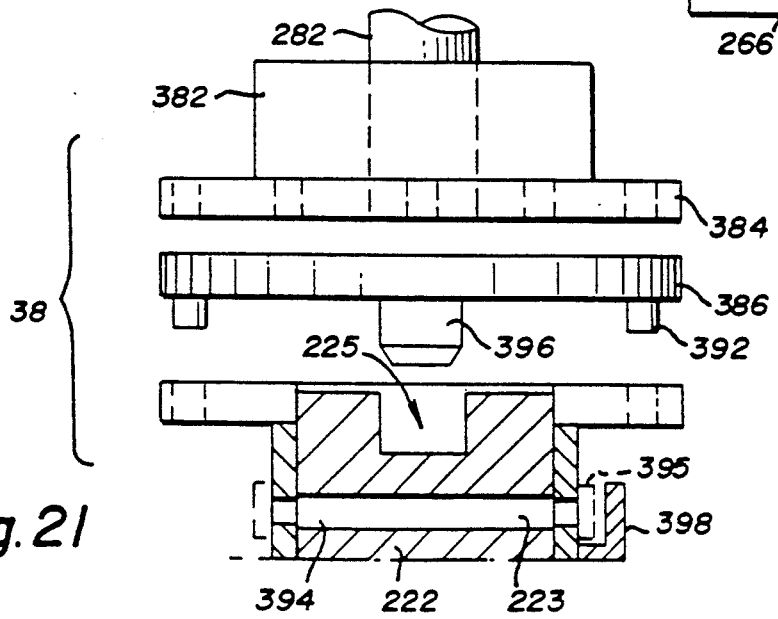
FIG. 21 is a fragmentary exploded view of one coupling device of the present invention.
Figure 22:
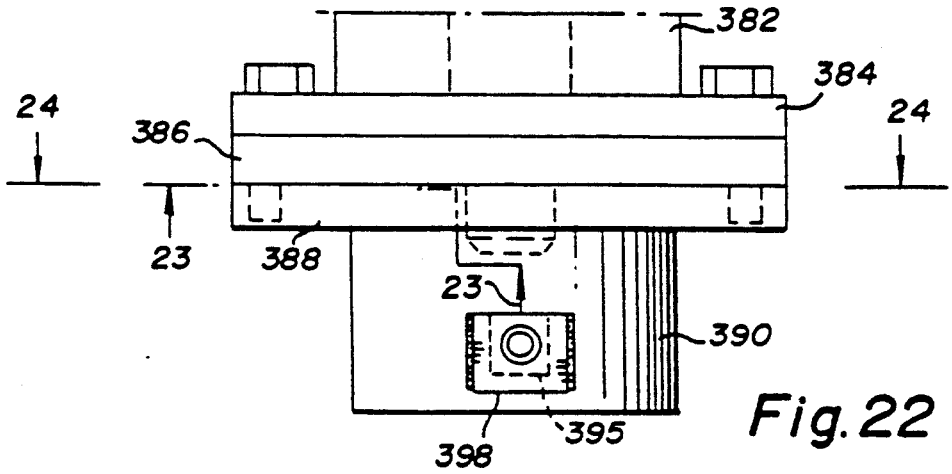
FIG. 22 is an assembled view of the coupling of FIG. 21.
Figure 23:
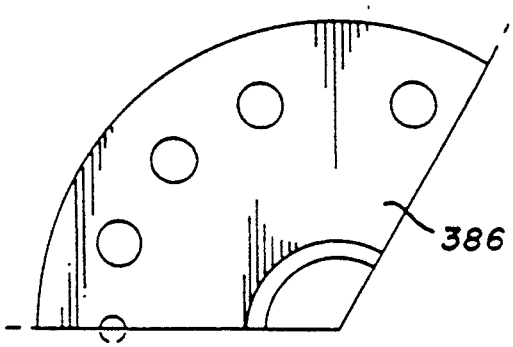
FIG. 23 is a partial plan view viewed in a direction indicated by lines 23—23 of FIG. 22.
Figure 24:
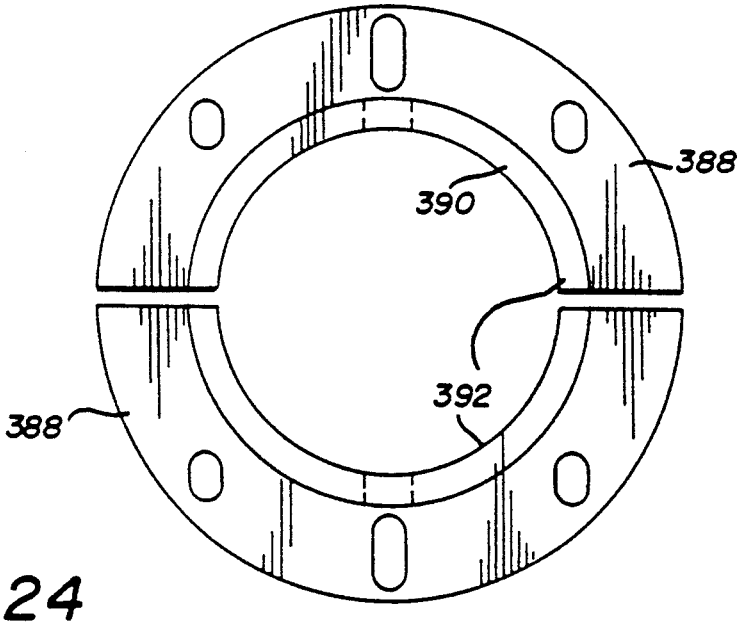
FIG. 24 is a partial plan view viewed in a direction indicated by lines 24—24 of FIG. 22.

The motor mount for the pump includes a horizontal plate 264 mounted on a steel support 270 (described below) and having bolt holes matching to the motor mounting bolt holes on the motor 28 as shown in FIG. 18. Spacers 266 extend from the motor mounting plate 264 radially outward of the motor mounting bolt circle. Blocks 268 may be welded to the steel support 270 as shown in both FIGS. 18 and 19 for aligning and locating the motor mounting plate. Bolt holes for fastening bolts are provide in the steel support 270 matching bolt holes in the spacers 266. In this manner, the motor and mount can be easily lifted in and out for maintenance and a gap can be provided for the flow of cooling air. If desired, the motor mount is useable by a variety of types of motors, such as hydraulic, pneumatic or electric.

A coupling device 38 for vertically coupling the motor shaft 282 substantially axially aligned to the pump shaft 22 is shown in FIGS. 21–24. A flexible coupling unit 382 such as an Oldham coupling, a double engagement coupling, or a "Fast's" steel coupling is attached to an end of the motor shaft and has a coaxial flange 384. The end of the pump shaft 22 has a concentric locating bore 225. A split coupling 390 is provided to the pump shaft and includes two half flanges 388 each having a depending half cylindrical member 392 attached thereto. A bolt 394 extends through a diametrical bore 223 provided in the end of the pump shaft and a pair of through bolt holes in the depending half cylindrical members 392 positioned such that the upper faces of the flanges 388 of the split coupling are substantially aligned with the upper end of the pump shaft. A clip-type nut holder 398 is provided on the outside surface of one of the depending flanges adjacent one of the bolt holes to hold the nut 395 attached to the bolt 394. This enables simple assembly of the coupling to the shaft even though the coupling is inside a cooling air shroud and superstructure assembly as described below. A pilot flange 386 is provided between the co-axial flange 384 of the flexible coupling unit 382 and the half flanges 388 of the split coupling 390. The pilot flange 386 has a center cylinder 396 extending co-axially from it sized to match and be received in the concentric locating bore 225 of the pump shaft 22. The flange portion of the pilot flange 386 has tapped holes for each half flange of the split coupling to be mounted to the pilot flange and for the co-axial flange of the flexible coupling unit to be matched from the other side to the pilot flange. Appropriately sized shoulder bolts are threadingly engaged in the tapped holes and join the half flanges of the split coupling and the co-axial flange of the flexible coupling unit to the pilot flange. Pins 392 are fitted into matching bores in the pilot flange and the half flanges to complement the shear strength of the bolts.

Figure 20:
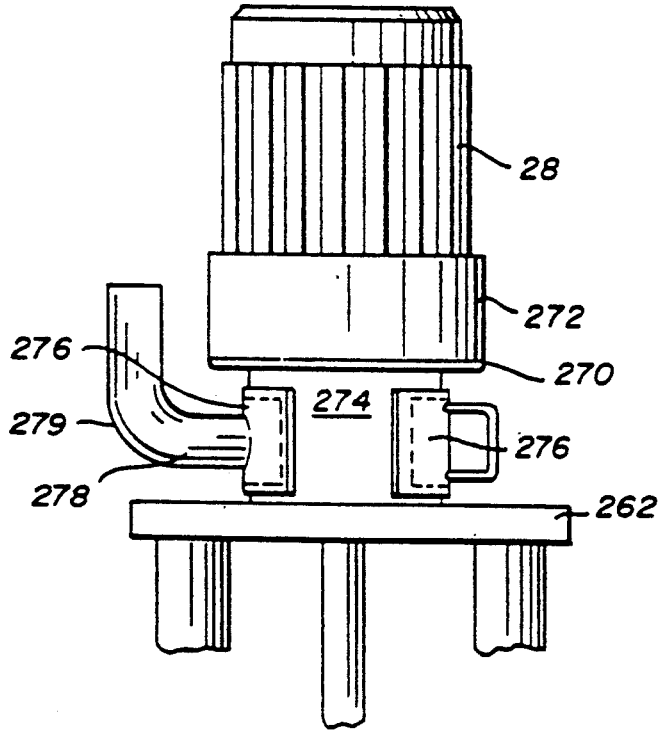
FIG. 20 is a perspective view of the motor, motor mount, and superstructure assembled.

In conjunction with the above described motor mount plate, the steel support 270 can include a steel cylindrical pipe 274 provided on the superstructure surrounding the coupling 38 between the motor shaft and the pump shaft and extending upwardly to the motor flange mounting plate 270. A further cylinder 272 extends upwardly from the motor flange mounting plate 270 and at least partially surrounds the motor 28 mounted thereon. Windows 275 are cut in the sides of the steel cylindrical pipe 274. Cover members 276 close the windows 275. The windows 275 are provided to enable access to the coupling unit 38. A cooling air pipe 278 is provided laterally of the steel cylindrical pipe and is connected to an elbow 279 connected to the steel cylindrical pipe 274 or to one of the window cover members 276 as shown in. FIG. 20 to enable cooling air to be provided via a small low pressure volume blower which uses unfiltered (remote) plant air. The cooling air flows in the elbow 279 and the pipe 278, around the coupling 38, and up through the annular space around the motor mounting plate 264 as supported by the spacers 266 and then around the motor 28 itself.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A pipe coupling adaptor for connecting between a graphite discharge pipe and a standard pipe flange connected to a standard, refractory-lined pipe elbow, said adaptor comprising two symmetrical half units having lower flange members for connecting to a superstructure of a pump, each half unit having one half of a standard pipe flange at its top, a pair of plate flanges along its vertical edges, and bolts in said plate flange; whereby said adaptor provides the necessary transition from the graphite discharge pipe necessary in the environment of the metal bath and also supports the weight of the discharge pipe without needing additional cementing when assembled.

2. A pipe coupling adaptor as claimed in claim 1, wherein each half unit further comprises an inwardly protruding triangular ridge which engages a corresponding groove in the graphite discharge pipe at the approximate middle of the inner surface of each of the halves.

3. A pipe coupling system for connecting between a discharge pipe and a standard pipe flange, said system comprising:

the discharge pipe formed of a refractory material, said discharge pipe for carrying molten metal;

the standard pipe flange connected to a standard, refractorylined pipe elbow; and an adaptor for connecting between said discharge pipe and said standard pipe flange, said adaptor comprising two symmetrical half units having lower flange members for connecting to a superstructure of a pump, each half unit having one half of a standard pipe flange at a top thereof, and a pair of plate flanges along vertical edges thereof, with bolts in said plate flanges, wherein said adaptor provides a transition from the refractory discharge pipe to the refractory-lined pipe elbow in an environment of a metal bath, said adaptor also supporting said discharge pipe without needing additional cementing when assembled.

4. A pipe coupling adaptor for connecting between a discharge pipe formed of a refractory material and a standard pipe flange connected to a standard, refractory-lined pipe elbow, said adaptor comprising two symmetrical half units having lower flange members for connecting to a superstructure of a pump, each half unit having one half of a standard pipe flange at its top, a pair of plate flanges along its vertical edges, and bolts in said plate flanges; whereby said adaptor provides a necessary transition from the discharge pipe necessary in the environment of the metal bath and also supports the weight of the discharge pipe without needing additional cementing when assembled, said adaptor including annular support means for supporting said discharge pipe.

5. A graphite pump shaft comprising a cylindrical main body having at one end a concentric counterbore, a diametral through bolt hole, and a shoulder, and the other end of the shaft being concentrically slightly tapered at an acute angle and having the most distal portion threaded.

6. A graphite pump shaft as claimed in claim 5, wherein said other end of said shaft is tapered at an angle of approximately three degrees.

7. A coupling device for vertically coupling one shaft substantially axially aligned to a second shaft comprising:

a flexible coupling unit attached to an end of one shaft and having a coaxial flange, the end of the second shaft having a concentric locating bore and a diameter, a split coupling provided to the second shaft and including two half flanges each having a depending half cylindrical member attached thereto, a bolt extending through a diametrical through bolt hole provided in the end of the second shaft and a pair of bolt holes in said depending half cylindrical members positioned such that the upper faces of the half flanges of the split coupling are substantially aligned with the upper end of the second shaft, a pilot flange provided between the co-axial flange of the flexible coupling unit and said half flanges of the split coupling, said pilot flange having a center cylinder extending co-axially from it sized to match and be received in the concentric locating bore of the second shaft, said flange portion of the pilot flange having tapped holes for each half flange of the split coupling to be mounted to the pilot flange and for the co-axial flange of the flexible coupling unit to be matched from the other side to the pilot flange, appropriately sized shoulder bolts threadingly engaged in said tapped holes and joining said half flanges of said split coupling and said co-axial flange of the flexible coupling unit to said pilot flange, and pins fitted into matching bores in the pilot flange, said half flanges and said co-axial flange complementing the shear strength of the bolts.

8. A coupling device as claimed in claim 7, further comprising a clip-type nut holder provided on an outside surface of one of the depending flanges adjacent one of said bolt holes to hold a nut attached to the bolt without use of a separate tool, whereby simple assembly of the coupling to the shaft is enabled even with the coupling being inside of a superstructure assembly.

* * * * *